US005762516A

United States Patent [19]

Itoga et al.

[11] Patent Number: 5,762,516

[45] Date of Patent: Jun. 9, 1998

[54] CONTACT AND TERMINAL CONNECTOR HAVING THE CONTACT

[75] Inventors: Shigekazu Itoga, Sagamihara; Rentara Osawa, Yokohama, both of Japan

[73] Assignee: Minnesota Mining and Manufacturing Company, St. Paul, Minn.

[21] Appl. No.: 647,946

[22] PCT Filed: May 30, 1996

[86] PCT No.: PCT/US96/08092

§ 371 Date: May 30, 1996

§ 102(e) Date: May 30, 1996

[87] PCT Pub. No.: WO96/42124

PCT Pub. Date: Dec. 27, 1996

[30] Foreign Application Priority Data

Jun. 9, 1995 [JP] Japan ..... 7-143635

[51] Int. Cl.[6] ..... H01R 4/24

[52] U.S. Cl. ..... 439/404; 439/941

[58] Field of Search ..... 439/404, 941, 439/402, 403, 395, 401, 397, 676

[56] References Cited

U.S. PATENT DOCUMENTS

| | | | |
|---|---|---|---|
| 3,798,587 | 3/1974 | Ellis et al. | 339/97 |
| 4,066,317 | 1/1978 | Bierenfeld et al. | 439/404 |
| 4,171,857 | 10/1979 | Forberg et al. | 339/97 |
| 5,186,647 | 2/1993 | Denkmann et al. | 439/395 |

FOREIGN PATENT DOCUMENTS

| | | | |
|---|---|---|---|
| 0 299 487 | 1/1989 | European Pat. Off. . | |
| 0 311 263 A2 | 4/1989 | European Pat. Off. . | |
| 0370380 | 5/1990 | European Pat. Off. | 439/403 |
| 0 456 340 A2 | 11/1991 | European Pat. Off. . | |
| 0 583 111 A1 | 2/1994 | European Pat. Off. . | |
| 1-107478 | 4/1989 | Japan . | |
| 6-223891 | 8/1994 | Japan . | |
| PCT/DK94/00107 | 3/1994 | WIPO . | |

*Primary Examiner*—Gary F. Paumen
*Assistant Examiner*—Tho Dac Ta
*Attorney, Agent, or Firm*—Gerald F. Chernivec

[57] ABSTRACT

To provide a contact capable of reducing the crosstalk between adjacent contacts, and a terminal connector with such contacts, capable of constructing a high speed communication network. The contact 10 has a generally central base section 12, contact sections 14, 16 extending from the opposite ends of the base section 12 generally normal thereto, connecting sections 18, 20 obliquely extending generally in the same direction transverse to the contact sections 14, 16, for connecting the base section 12 with the contact sections 14, 16, respectively. One connecting section 18 has a first part 18*a* extending from one lengthwise end of the base section 12 generally normal thereto while maintaining a lateral distance from the contact section 14, a second part 18*b* extending from the contact section 14 in parallel thereto, and a third part 18*c* extending in the crossing direction to the surface of the contact section 14 to connect the first part 18*a* to the second part 18*b*. The other connecting section 20 extends from the contact section 16 in parallel thereto and is vertically connected to the other lengthwise end of the base section 12.

5 Claims, 14 Drawing Sheets

CONTACT AND TERMINAL CONNECTOR HAVING THE CONTACT

DETAILED DESCRIPTION OF THE INVENTION

1. Field of Utilization in Industry

The present invention relates to a contact for providing an area to be electrically and detachably connected with another electro-conductor at a terminal of an electric wire.

Further, the present invention relates to a terminal connector provided with such a contact. Particularly, the present invention is suitably applicable to a cable-connecting apparatus used for a high-speed communication network.

2. Prior Art

Recently, an amount and speed of information transmitted by an electrical communication network, have been significantly accelerated. In such a high speed communication network, coaxial cables or optical cables are generally used because they have favorable transmission characteristics, particularly excellent in crosstalk-proof capacity. However, when the network is formed, e.g., in a business building, a cable of twisted-pair (i.e., a balanced cable) is preferably used due to its desirable handling property in the installing operation. Although the twisted-pair cable itself has been improved to be capable of high-speed transmission of information by the recent development of cable-manufacturing technology, an overall communication system must be suited to the high-speed communication, including attachments such as terminal connectors constituting a cable-connecting device.

On this point of view, according to the United States standards of electric communication systems for business buildings (ANSI/EIA/TIA 568), networks are classified into several categories in accordance with the information-transmission speeds, wherein the system having the speed higher than 100 MB/sec belongs to category 5. If a high speed data communication is desired by the use of computers or the like in the business building, the network satisfying the category 5 is necessary.

To achieve such a high speed transmission of information as category 5, it is necessary to suppress the crosstalk between adjacent elector-conductors lower than a predetermined level. When the twitted-pair cable is used, it is well-known that the crosstalk in the cable can be reduced by twining core wires consisting of the pair. However, the crosstalk occurs not only in the cable but also in other conductor portion such as a contact is a connector.

Japanese Unexamined Patent Publication (Kokai) No. 1-107478 discloses a connector device used for a cross-terminal of electric communication network in a business building or others and an electro-conductive metallic contact element (i.e., a contact) built in the connector device. This connector device comprises a plurality of connector blocks supported by a base, wherein a plurality of pairs of contacts are orderly arranged in the respective connector block for the connection of a plurality of pairs of core wires. Generally, in the cross-terminal, a plurality of connector blocks with a plurality of pairs of contacts are provided at a predetermined arrangement in a connector device, for terminating, respectively, a group of input cables coming from outside the building and a group of output cables going to the interior of the building. Between the connector blocks for terminating the input cables and those for terminating the output cables, free ends of the respective contacts connected to the respective cables are switchably connected to each other via patch cords to be capable of switching information-transmission paths if necessary.

The contact disclosed in Japanese Unexamined Patent Publication (Kokai) No. 1-107478 is formed by bending a straightly-extending elongated thin metallic plate to a generally U-shape. In each of lengthwise end areas of the contact, a slot extending in the longitudinal direction is formed to provide a U-shaped contact section. When a core wire with an insulation coating is inserted under pressure into the slot of the contact, the opposed edges of the slot of the contact section break the insulating coating to establish the conductivity between the core wire and the contact while firmly securing the core wire to the contact. Such a contact structure is generally referred to as "IDC (insulation displacement contact)", and a method for pressingly inserting the coated core wire into the IDC slot is generally referred to as "press-connection". Two contacts for connecting a pair of core wires in a twisted-pair cable are arranged generally in parallel to each other in the above block, and a plurality of such pairs of contacts are arranged generally in parallel to each other.

Japanese Unexamined Patent Publication (Kokai) No. 6-223891 discloses patch plugs used for cross-terminals in an electric communication network for business buildings or the like. The patch plug is attached to the respective end of the patch cord and has a pair of contacts for terminating a pair of core wires of the patch cord. The contact of the patch plug has a free end adapted to be into slide-contact with a free end of the cable-side contact in the above connector block, whereby the switching operation is facilitated between the connector blocks.

The contact of patch plug disclosed in Japanese Unexamined Patent Publication (Kokai) No. 6-223891 has an IDC type contact section at one end for terminating the patch cord, and a flat contact section at the other end for slide-contact with the contact in the connector block. A conductive portion between the IDC type contact section and the flat contact section is bent to once intersect the corresponding portion of the adjacent contact in a non-touch manner. With this pair of contacts intersecting each other, a pair of wires of the patch cord are connected, and a pair of contacts in the connector block connecting to a pair of core wires in the twisted-pair cable are also brought into contact. By using this contact, it is possible to reduce the crosstalk in the contacts of patch plug.

Problems to be Solved by the Invention

According to the connector device disclosed in Japanese Unexamined Patent Publication (Kokai) No. 1-107478, the crosstalk is so significant between adjacent contacts in a plurality of pairs of contacts arranged generally in parallel to each other that this connector device is unsuitable for a high-speed communication satisfying the category 5 stated before. Also according to the patch plug disclosed in Japanese Unexamined Patent Publication (Kokai) No. 6-223891, the pair of contacts on the input side and that on the output side are arranged while reversing the relative positions, whereby the erroneous connection of electric wires is liable to occur. Particularly, in the connector device of the cross-terminal, it is a custom to arrange a pair of core wires of the input cable and that of the output cable in the same relative positional relationship regarding the polarity. If the pair of contacts wherein the relative positions of contact sections on the input side are reversed to those on the output side are used in this connector device, the relative positions of the twisted-pair wires regarding the polarity should be reversed between the input and output cables. This, however, is contrary to the custom and increases the probability of erroneous connection.

Accordingly, an object of the present invention is to provide a contact wherein the relative positions of adjacent contact sections are the same on one side (e.g., input side) and on the other side (e.g., output side) and capable of reducing the crosstalk between the adjacent contacts. Another object of the present invention is to provide a terminal connector with such contacts, capable of constructing a high-speed communication network.

Means for Solving the Problems

To achieve the above objects, the present invention provides a contact made of an elongated electro-conductive metallic plate with a generally flat surface, which comprises a generally central base section and end contact sections extending generally normal to the base section, thereby forming a zone to be electrically and detachably connected with another electro-conductor at a terminal of an electric wire, characterized in that the end contact sections linearly extend generally in the same direction while opposing the generally flat surfaces thereof to each other; each contact section being connected to the base section by a connecting section obliquely extending in the same direction transverse to the contact section; and at least one connecting section having a portion extending in the direction crossing the surface of the contact section.

In a preferred embodiment, in the above contact, at least one of the contact sections may have a slot longitudinally extending from the lengthwise end of the metallic plate, into which an electric wire is received.

According to another aspect of the present invention, a terminal connector is provided, comprising a body made of an electro-insulating material and more than one contact-pair to be connected to more than one outer conductor-pair having polarities different from each other, characterized in that each of the two contacts in the respective contact-pair is made of an elongated electro-conductive metallic plate with a generally flat surface, and comprises a generally central base section, end contact sections linearly extending generally in the same direction normal to the base section while opposing the generally flat surfaces thereof to each other, and connecting sections for connecting the contact sections to the base section and obliquely extending in the same direction transverse to the contact sections; in that at least one of the connecting sections in at least one of the two contacts in the contact-pair has a portion extending in the direction crossing to the surface of the contact section; and in that two contacts in the contact-pair are arranged so that the connecting sections of one contact intersects the corresponding connecting sections of the other contact with a small gap therebetween and the respective contact sections of the contacts are arranged generally on two mutually opposed common planes.

In another preferred embodiment, the terminal connector may further comprise second contact-pairs, each having two second contacts made of an elongated electro-conductive metallic plate with a generally flat surface; each second contact comprising a generally central base section and two contact sections linearly extending from the base section generally normal thereto while opposing the generally flat surfaces thereof to each other, and being spaced with each other so as to generally align the respective contact sections of the second contact on mutually opposed two common planes; the respective second contact-pairs being located adjacent to the contact-pairs, of which connecting sections intersect each other, so that the respective contact sections of all the contact-pairs are generally arranged on the mutually opposed two common planes.

Mode of Operation

Two of the contacts having the above structure are combined with each other so that both the connecting sections of one contact intersect the corresponding ones of the other contact with a small gap therebetween and both the contact sections of the respective contact are arranged on two common planes. Thereby, the one contact twice intersects the other contact in a non-touch manner between one end and the other end contact. By this twice intersection, the crosstalk can effectively be reduced between the contacts. In addition, since the relative positions of the adjacent contact sections on one side are not reversed to those on the other side, the erroneous connection of electric wires can also be avoided.

EMBODIMENTS

The present invention will be described in more detail below with reference to the preferred embodiments illustrated in the attached drawings, wherein the same or similar elements are designated by common reference numerals.

FIG. 1 shows a contact 10 according to one embodiment of the present invention. The contact 10 is made of an elongated electro-conductive metallic plate having generally flat front and back surfaces, and consists of a generally central base section 12 and two contact sections 14, 16 extending from the respective ends of the base section 12 generally normal thereto. The contact sections 14, 16 extend linearly in the same direction while opposing the generally flat surfaces thereof to each other. The base section 12 and the contact sections 14, 16 are connected to each other by connecting sections 18, 20, respectively, which obliquely extend in the same direction transverse to the contact sections 14, 16.

Thereby, the contact sections 14, 16 are arranged at positions distant by a in the lateral direction from the base section 12. In the following description, the generally flat surface of the contact 10, opposing a space delimited by the base section 12, the respective contact sections 14, 16 and the respective connecting sections 18, 20, is referred to as an "inner surface" and that opposite thereto as an "outer surface".

The respective contact section 14, 16 has a slot 22 formed longitudinally with the electro-conductive metallic plate from the lengthwise edge thereof. Thus the contact section 14, 16 is operable as an IDC used for the press-connection of the coated core wire (not shown). Or it is also possible to establish the conductivity by the slide-contact of the generally flat surface of the respective contact section 14, 16 with the other contact or the like.

One of the connecting sections 18 has a first part 18*a* extending from one lengthwise end of the base section 12 generally normal thereto and parallel to the contact section 14 while being shifted by a lateral distance therefrom, a second part 18*b* extending from the contact section 14 parallel thereto, and a third part 18*c* for connecting the first part 18*a* and the second part 18*b* to each other while extending in the crossing direction to the surface of the contact section 14. Accordingly, a stepped portion is formed in the connecting section 18 at the third part 18*c*, whereby the contact section 14 is located at a position shifted outward by a desired distance B from the first part 18*a* of the connecting section 18.

The other connecting section 20 extends from the contact section 16 parallel thereto and is vertically connected to the other lengthwise end of the base section 12. Accordingly, there is no stepped portion in the connecting section 20.

Two of the contacts 10 of the above structure having the same shape are combined to form a pair of contacts capable of reducing the crosstalk between the adjacent contacts. As shown in FIG. 2, the two contacts 10 are arranged so that the connecting section 18 of the one contact 10 intersects the connecting section 20 of the other contact 10 in a non-touch manner. Note the connecting section 20 is located on the outer surface side of the first part 18*a* of the connecting section 18 and both the base sections 12 are located parallel to each other generally on the same plane. By arranging the base sections 12 of the respective contacts 10 to be apart from each other by a distance B in the longitudinal direction, the contact section 14 held by the connecting section 18 of the one contact 10 and the contact section 16 held by the connecting section 20 of the other contact 10 are located generally on the same plane. As the two contacts 10 have exactly the same shape, it is possible to arrange both the contact sections 14, 16 of the respective contact 10 on the two common planes opposed to each other.

According to the pair of contacts 10 arranged in such a manner, the crosstalk between the contacts can be reduced due to the intersection of the connecting sections 18, 20. In addition, since the intersection occurs twice in one pair of contacts, positions of the contact sections 14, 16 of the one contact 10 relative to those of the contact sections 16, 14 of the other contact 10 become identical either on the left-side (e.g., input side) or on the right-side (e.g., output side) in FIG. 2.

The contact according to the present invention may have various shapes other than the above. For example, as shown in FIG. 3, the contact section 14 held on the stepped connecting section 18 may be arranged at a position shifted from the first part 18*a* of the connecting section 18 toward the inner surface thereof by a desired distance. By combining two of such contacts 10A of the same shape in a similar manner as FIG. 2, it is also possible to form a pair of contacts capable of reducing the crosstalk and avoiding the erroneous wire connection. In this case, the connecting section 20 with no stepped portion of the one contact 10A is arranged on the inner surface side of the first part 18*a* of the connecting section 18 of the other contact 10A.

Alternatively, as shown in FIG. 4, the connecting section 18 may have a first part 18*a* extending from one lengthwise end of the base section 12 generally normal thereto, a second part 18*b* extending from the contact section 14 in parallel thereto and arranged generally on the plane common to the first part 18*a*, a fourth section 18*d* extending generally parallel to the contact section 14, while being shifted therefrom, between the first part 18*a* and the second part 18*b*, and two of third sections 18*c*, each extending in the crossing direction to the surface of the contact section 14 and connecting the fourth part 18*d* with the first part 18*a* or the second part 18*b*. Thereby, the connecting section 18 has two stepped portions at the third parts 18*c*, respectively. Thus, a recess having a desired depth can be formed on the outer surface of the connecting section 18 by these stepped portions.

By combining two of such contacts 10B of the same shape in a similar manner as FIG. 2, it is also possible to form a pair of contacts capable of reducing the crosstalk and avoiding the erroneous wire connection. In this case, the connecting section 20 with no stepped portion of the one contact 10B is arranged on the outer surface side of the fourth part 18*d* of the connecting section 18 of the other contact 10B. In this contact 10B, the fourth part 18*d* may be shifted from the contact section 14 toward the outer surface side.

As shown in FIG. 5, both the connecting sections 18, 20 may have stepped portions. In this case, similar to the connecting section 18, the connecting section 20 has a first part 20*a* extending from one lengthwise end of the base section 12 generally normal thereto and parallel to the contact section 16 while being shifted by a lateral distance therefrom, a second part 20*b* extending from the contact section 16 parallel thereto, and a third part 20*c* for connecting the first part 20*a* and the second part 20*b* to each other while extending in the crossing direction to the surface of the contact section 16. The contact section 16 is located at a position apart inward by a desired distance B from the first part 20*a* of the connecting section 20. While, the contact section 14 held by the connecting section 18 is preferably located at a position apart outward by a desired distance B from the first part 18*a* of the connecting section 18.

By combining two of such contacts 10C of the same shape in a similar manner as FIG. 2, it is also possible to form a pair of contacts capable of reducing the crosstalk and avoiding the erroneous wire connection. In this case, the first part 20*a* of the connecting section 20 of the one contact 10C is arranged on the outer surface side of the first part 18*a* of the connecting section 18 of the other contact 10C. If the contact section 14 hold by the connecting section 18 of the one contact 10C and the contact section 16 held by the connecting section 20 of the other contact 10C are located generally on the same plane while maintaining the above relationship, a distance between the first part 18*a* of the connecting section 18 and the first part 20*a* of the connecting section 20 is approximately twice that in the embodiment shown in FIG. 2, whereby the crosstalk-proof capacity is enhanced.

In either of the above embodiments, the base section 12, the contact sections 14, 16 and the connecting sections 18, 20 may have any surface shapes. For example, as shown in FIG. 5, a slide-contact type contact section 14, 16 with no slot (i.e., non-IDC type) may be used, or the first part 18*a*, 20*a* which is an intersecting portion of the connecting section 18, 20 may have a narrower width.

According to the above embodiments, a pair of contacts for terminating a pair of electric wires having different polarities can be formed by two of the same shaped contacts. In such a structure, the manufacturing cost of the pair of contacts can be reduced compared to one using contacts having different shapes. However, if the manufacturing cost is not taken into consideration, it is possible, as shown in FIG. 6, to combine the contact 10C shown in FIG. 5 with the contact 10D having no step portions in any of the connecting sections 18, 20 to result in a pair of contacts capable of minimizing the crosstalk and avoiding the erroneous wire connection. In such a case, the connecting section 20 of the contact 10D is arranged on the outer surface side of the first part 18*a* of the connecting section 18 of the contact 10C, and the connecting section 18 of the contact 10D is arranged on the inner surface side of the first part 20*a* of the connecting section 20.

Further, as shown in FIG. 7, a contact 10E may be used, wherein each of the contact sections 14, 16 is arranged at a position apart from the first part 18*a*, 20*a* of the connecting section 18, 20 toward the outer surface side thereof. As shown in FIG. 8, the contact 10E may be combined with a contact 10F having no stepped portions in any of the connecting sections 18, 20 to form a pair of contacts capable of minimizing the crosstalk and avoiding the erroneous wire connection. In such a case, the base section 12 of the contact 10F is longer than the base section 12 of the contact 10E so that the connecting sections 20, 18 of the contact 10F are arranged, respectively, at positions on the outer surface side of the first parts 18*a* of the connecting section 18 and the first part 20*a* of the connecting section 20 of the contact 10F.

FIGS. 9 and 10 illustrate a terminal connector 24 according to the present invention, with the contacts 10 shown in FIG. 1. The terminal connector 24 has a housing body 26 made of an electro-insulating material, and ten contacts held on the body 26 at predetermined positions at a pitch therebetween. The terminal connector 24 can be used as a connector block to be supported by a base in a cross-terminal of an electrical communication network for a business building or others (see Japanese Unexamined Patent Publication (Kokai) No. 1-107478).

In the terminal connector 24, as shown in FIG. 2, five pairs of contacts are formed by combining the ten contacts 10 of the same shape so that the contact sections 14, 16 held by the connecting sections 18, 20 of the pair of contacts intersecting each other are orderly arranged generally on two planes, respectively, which planes are common to all the pairs of contacts and opposed to each other, as shown in FIG. 9. Accordingly, the terminal connector 24 can connect the terminal ends of five pairs of outer conductors to a group of contacts arranged on the upper side (e.g., input side) of FIG. 9, while connecting the terminal ends of other five pairs of outer conductors to a group of contacts arranged on the lower side (e.g., output side).

The body 26 has a continuous side wall 28 defining the upright outer peripheral surface. A flange 30 laterally projects from the upper end of the side wall 28, and wall members 32, 34 are alternately arranged along the alignment of the contacts 10 while extending on the flange 30 in the lateral direction. Fins 36 are provided on the opposed surfaces of the wall members 32, 34 so that zigzag channels 38, 40 are formed by the cooperation of one fin 36 on the one wall member with two fins 36 on the other wall member, for positioning electric wires (not shown). In addition, thin walls 42, 44 extend inward from the respective wall members 42, 44, and grooves 46 are formed on the opposed surfaces of the thin walls 42 and 44, for accommodating the contact sections 14, 16 of the contact 10. The wall 42 extending from the wall member 32 terminates at a position above from the lower end of the side wall 28 by a predetermined distance so that the connecting sections 18, 20 of the respective contacts 10 constituting the pair can intersect each other (see FIG. 10).

As described above, by using pairs of the contacts 10, a terminal connector 24 is obtainable, which is capable of minimizing the crosstalk between the contacts within one pair and avoiding the erroneous connection of electric wire to the contact. However, in this terminal connector 24, since all the pairs of contacts have the same structure, there is a problem in that a crosstalk may generate between the adjacent pairs. To solve this problem, as shown in FIG. 11, a contact pair 48 with the intersecting connecting sections, effective for reducing the crosstalk, alternates with the conventional contact pair 50 having no intersections, so that the crosstalk is minimized even between the adjacent pairs.

The contact pair 48 shown in FIG. 11 has the same structure as that of the pair of contacts 10 shown in FIG. 2. While, two contacts 52 for forming the contact pair 50 is made of an elongated electro-conductive metallic plate having generally flat front and back surfaces. Each of the contacts 52 has a generally central base section 54, and two contact sections 56 linearly extending from both ends of the base section 54 in the same direction generally normal thereto so that the generally flat surfaces thereof are opposed to each other. The two contacts 52 are arranged generally in parallel to each other at a distance therebetween so that the respective contact sections 56 are orderly aligned generally on two common planes opposite to each other. Similar to a plurality of contact pairs shown in FIG. 9, the contact pairs 48 and 50 are arranged so that two groups of contact sections 14, 16 and 56 are aligned generally on the two common planes opposite each other, respectively.

By aligning a group of the alternate contact pairs 48 and 50 at predetermined positions on the body 26, instead of a group of contact pairs formed by the contacts 10 in the terminal connector 24 shown in FIG. 9, it is possible to reduce the crosstalk not only within one contact pair but also between the adjacent contact pairs, resulting in the terminal connector capable of minimizing the total crosstalk.

According to the experiment conducted by the applicant by using various terminal connectors having the same dimensions and specifications, the level of crosstalk is −36 dB in the conventional terminal connector formed solely of the contact pairs 50; −40 dB in the terminal connector 24 formed solely of the contact pairs 48 shown in FIG. 9; and −43 dB in the terminal connector formed of the alternate arrangement of the contact pairs 48 and 50. From this result, the crosstalk reduction effect will be clearly understood.

The terminal connector according to the present invention may be formed of a row of contacts of various shapes built-in in an optionally-shaped housing other than the body 26 described above. FIGS. 12 through 14 show modified rows of contacts consisting of different kinds of pairs arranged alternately to each other. In the contact row shown in FIG. 12, one group of contact sections 14, 16 and 56 of the contact pairs 48, 50 arranged on the nearer side in the drawing is of an IDC type with a slot 22, and another group of contact sections 14, 16 and 56 arranged on the farther side is of a flat slide-contact type. According to the row of contacts shown in FIG. 13, all the contact pairs 48, 50 are formed of a flat slide-contact type structure. Further, in the row of contacts shown in FIG. 14, one group of contact sections 14, 16 and 56 of the contact pairs 48, 50 arranged on the nearer side in the drawing is of a flat slide-contact type structure with a cantilever 58, and another group of contact sections 14, 16 and 56 arranged on the farther side is of an IDC type with a slot 22. According to the contact section having the cantilever 58, the direct conductivity can be established between a printed circuit of a printed circuit board (not shown) and the contact by inserting the printed circuit board into a gap between a housing (not shown) for accommodating the row of contacts and the cantilever 58.

Effect of the Invention

As apparent from the above description, according to the present invention, a contact is provided, which is capable of maintaining the same relative positional relationship between the adjacent contacts on one side and on the other side as well as effectively minimizing the crosstalk between the adjacent contacts. Further according to the present invention, a terminal connector with such contacts is provided, which is capable of avoiding the erroneous wire connection and effectively reducing the crosstalk between the adjacent contacts to be suitably utilized for constructing a high-speed communication network for a business building or others.

EXPLANATION OF REFERENCE NUMERALS

Figure 1:
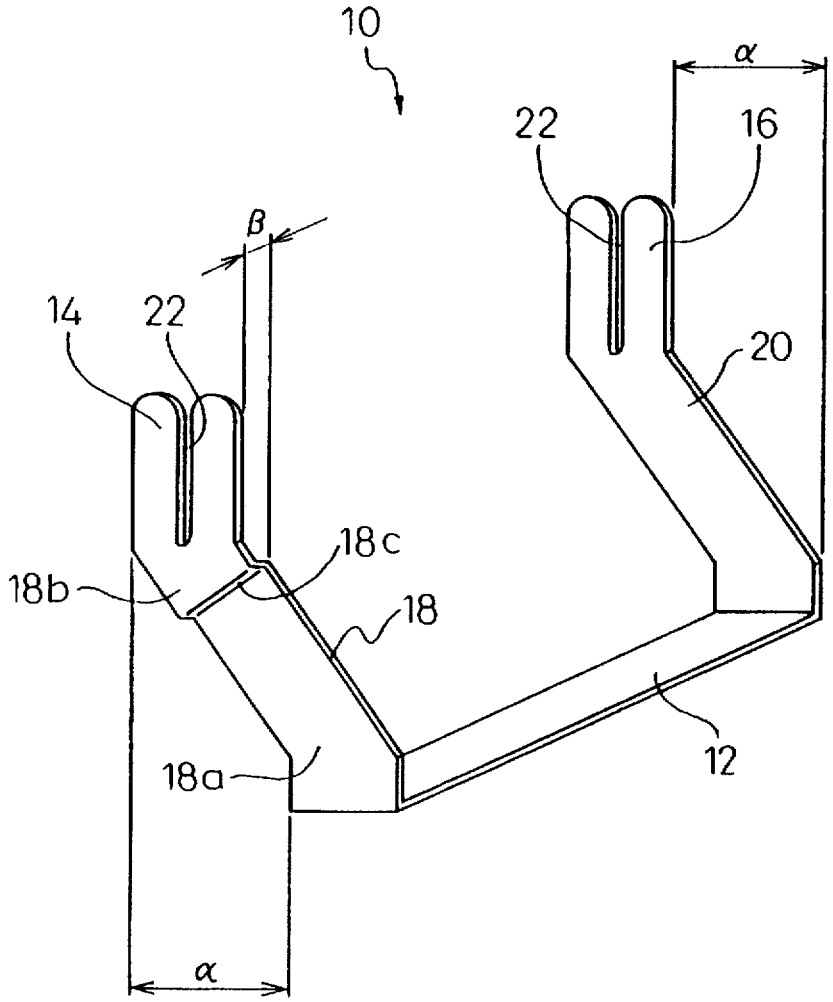
FIG. 1 A perspective view of a contact according to an embodiment of the present invention.
Figure 2:
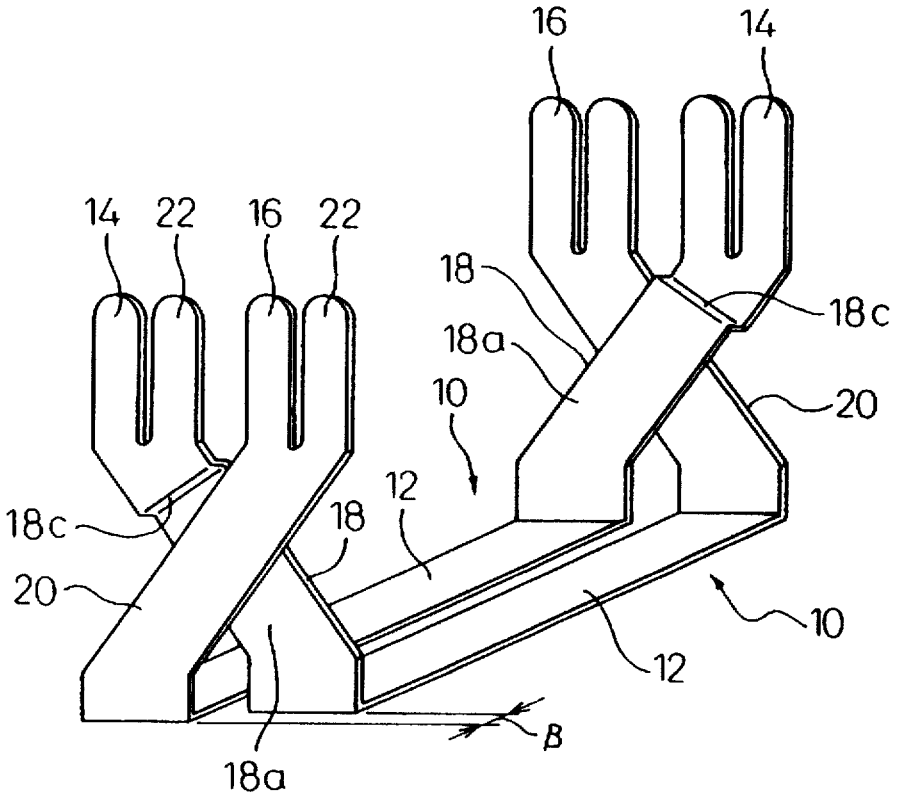
FIG. 2 A perspective view of a contact pair using the contacts shown in FIG. 1.
Figure 3:
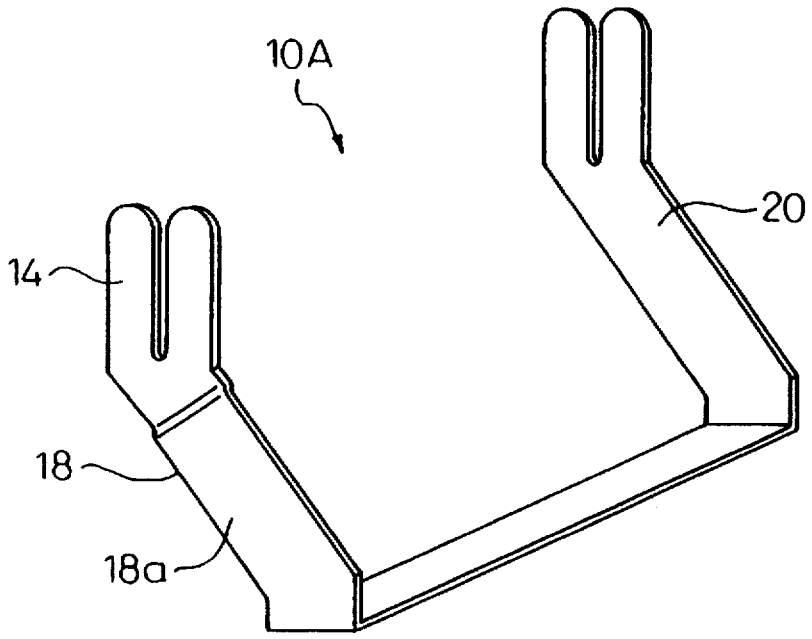
FIG. 3 A perspective view of a modified contact.
Figure 4:
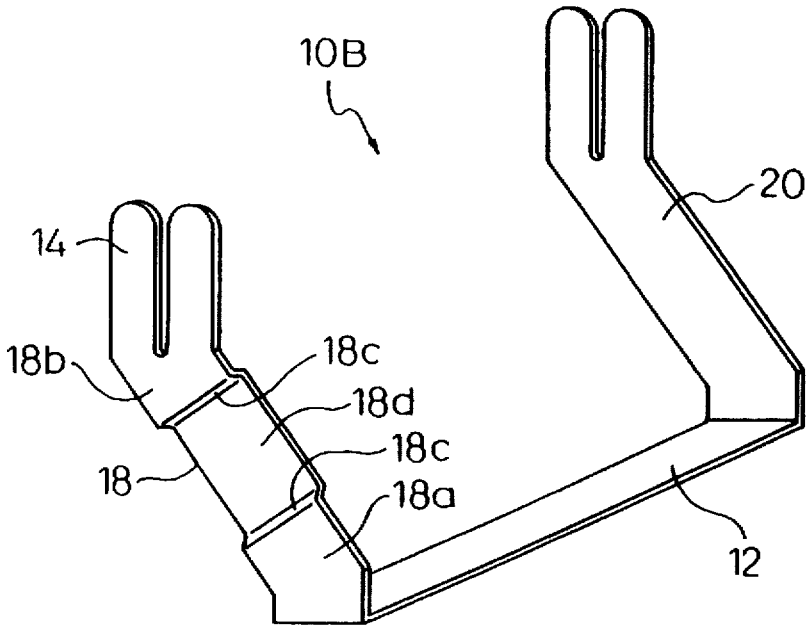
FIG. 4 A perspective view of another modified contact.
Figure 5:
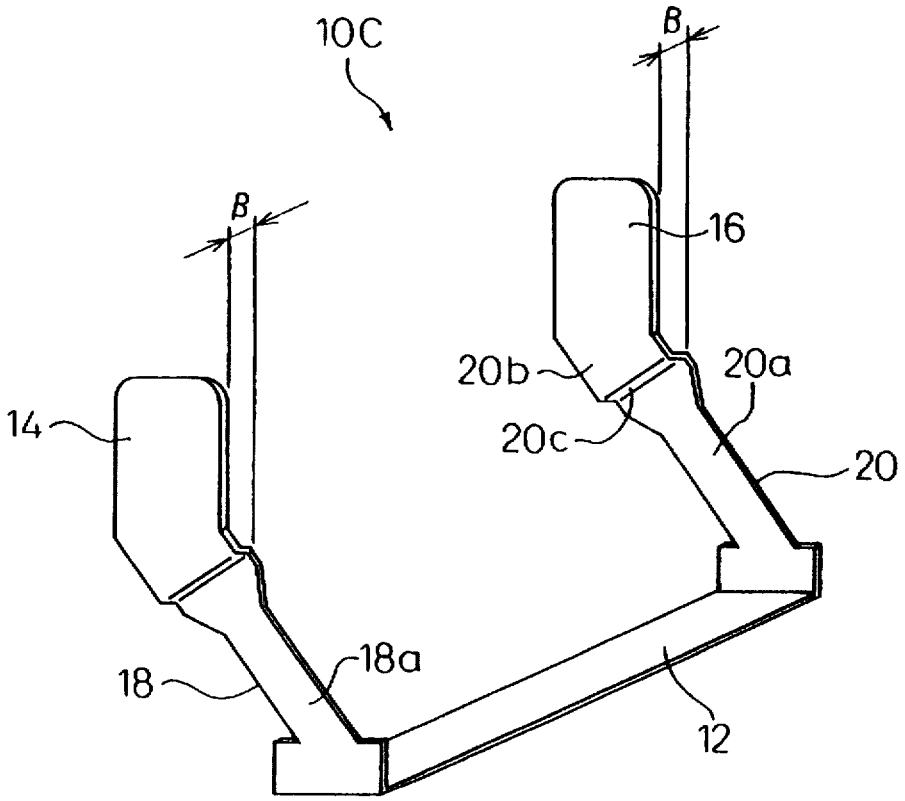
FIG. 5 A perspective view of further modified contact.
Figure 6:
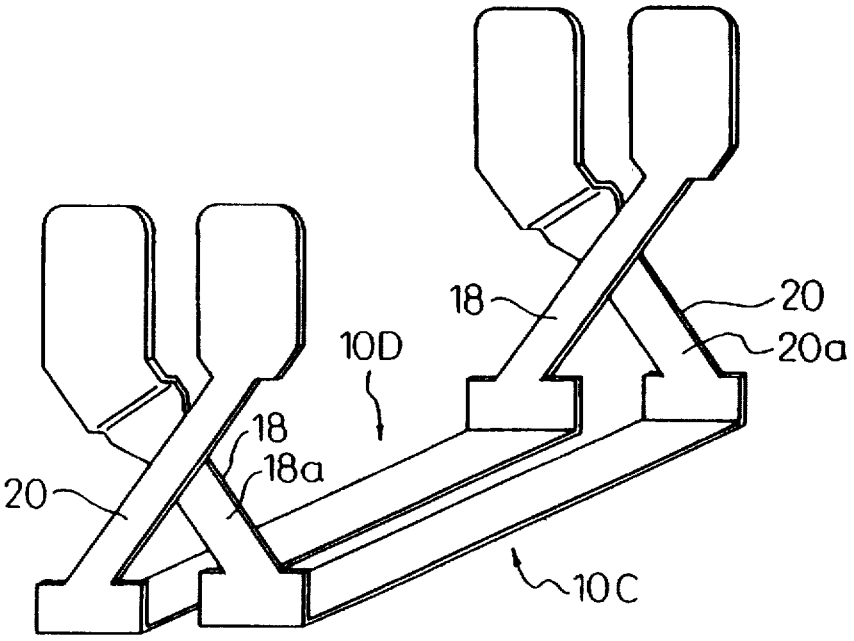
FIG. 6 A perspective view of a contact pair using the contacts shown in FIG. 5.
Figure 7:
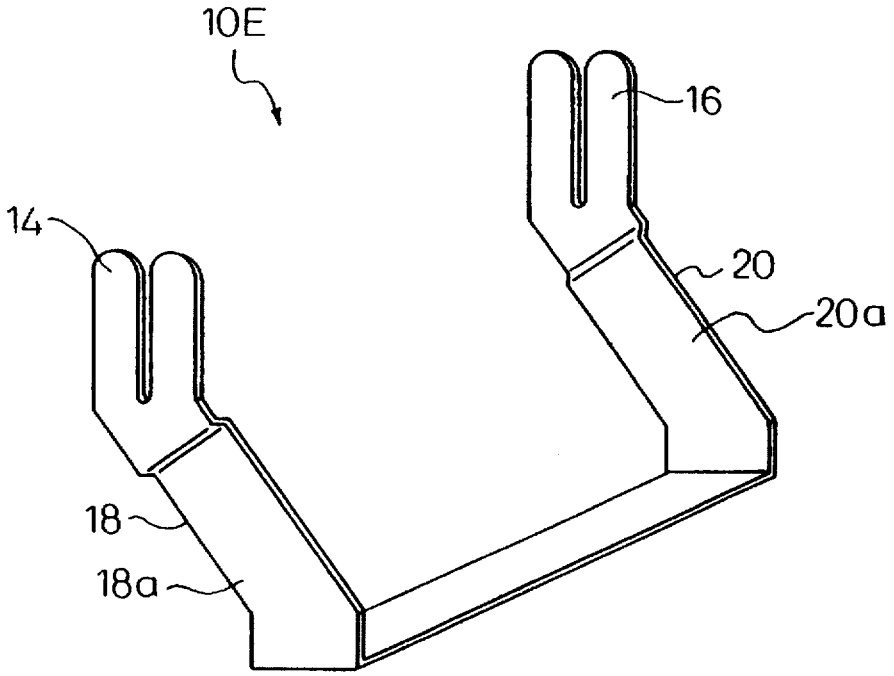
FIG. 7 A perspective view of further more modified contact.
Figure 8:
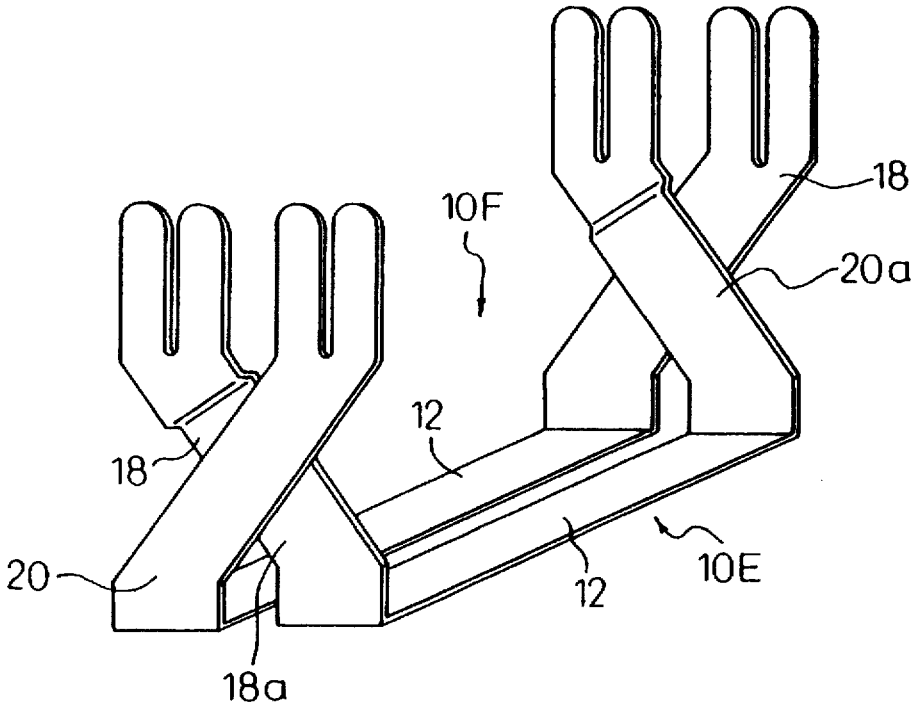
FIG. 8 A perspective view of a contact pair using the contacts shown in FIG. 7.
Figure 9:
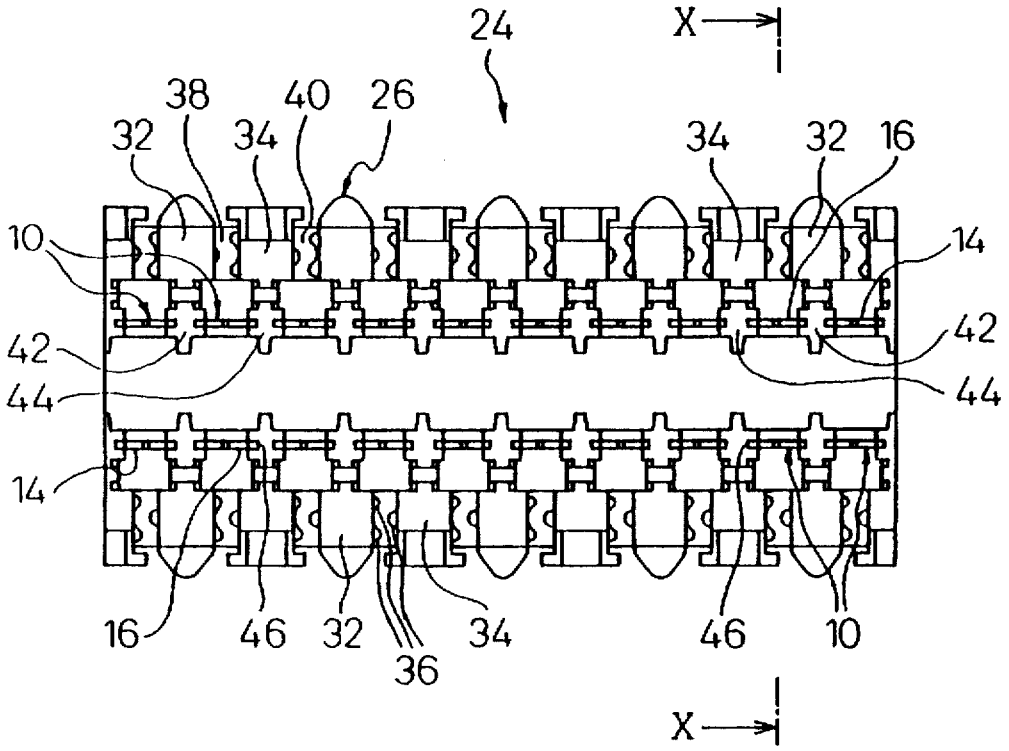
FIG. 9 A plan view of a terminal connector according to an embodiment of the present invention.
Figure 10:
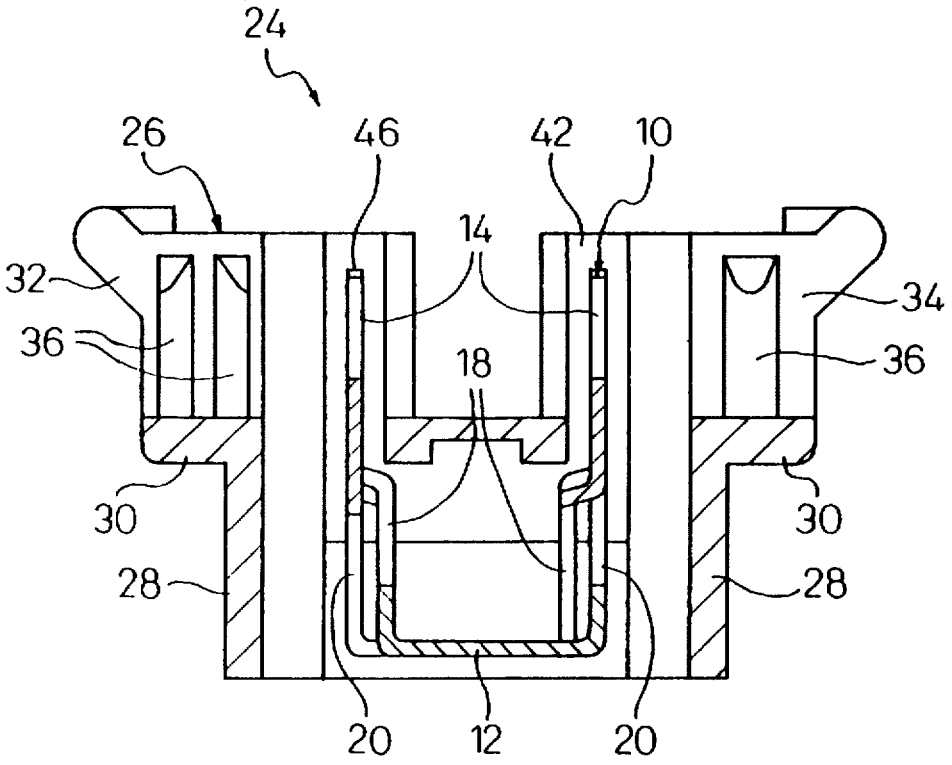
FIG. 10 A cross-section taken along a line X—X in FIG. 9.
Figure 11:
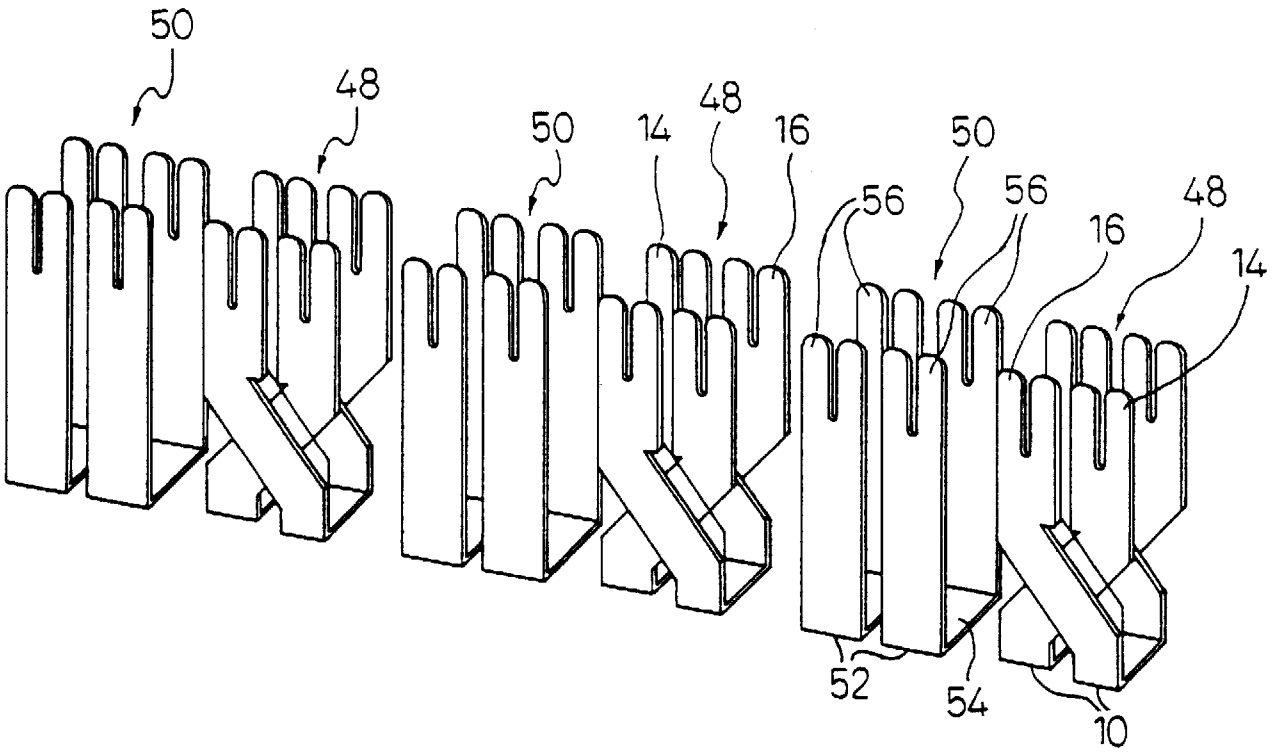
FIG. 11 A perspective view of a row of contacts using the contacts according to an embodiment of the present invention.
Figure 12:
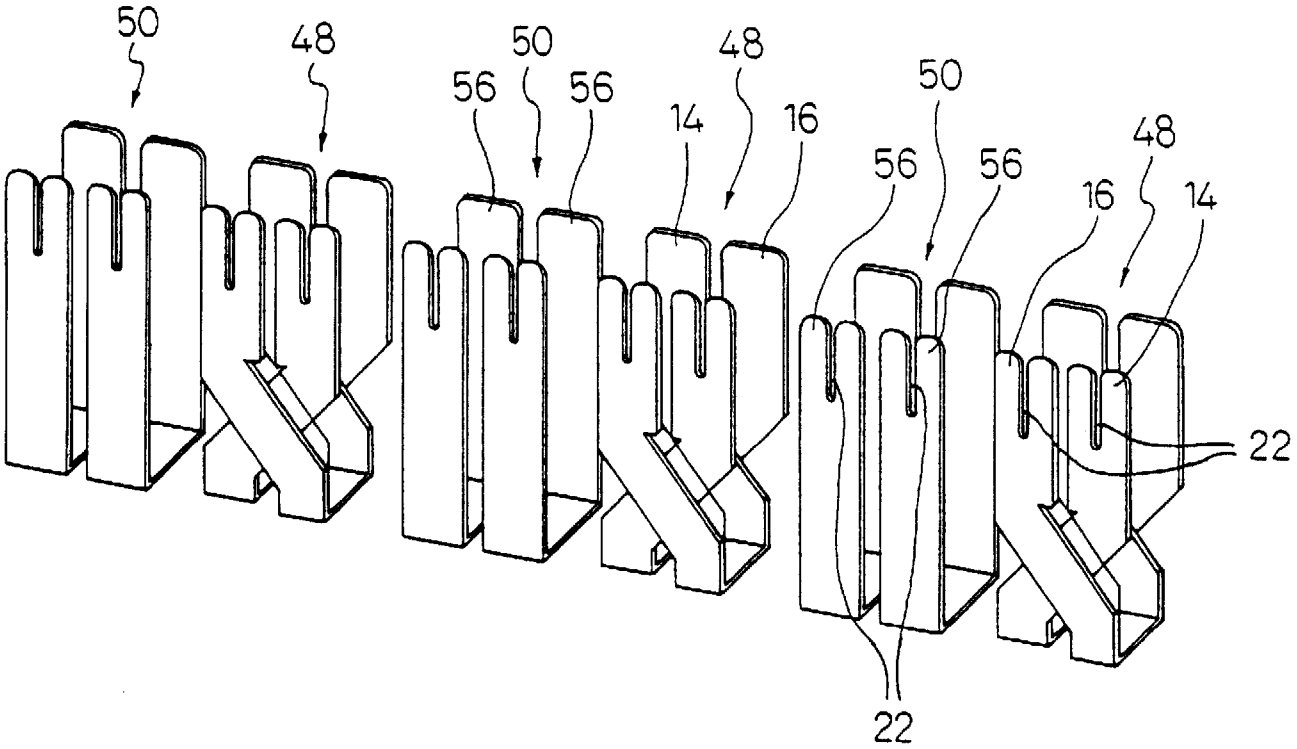
FIG. 12 A perspective view of a row of contacts using the contacts according invention, to another embodiment of the present FIG. 13 A perspective view of a row of contacts using the contacts according invention to further embodiment of the present FIG. 14 A perspective view of a row of contacts using the contacts according invention to further more embodiment of the present
Figure 13:
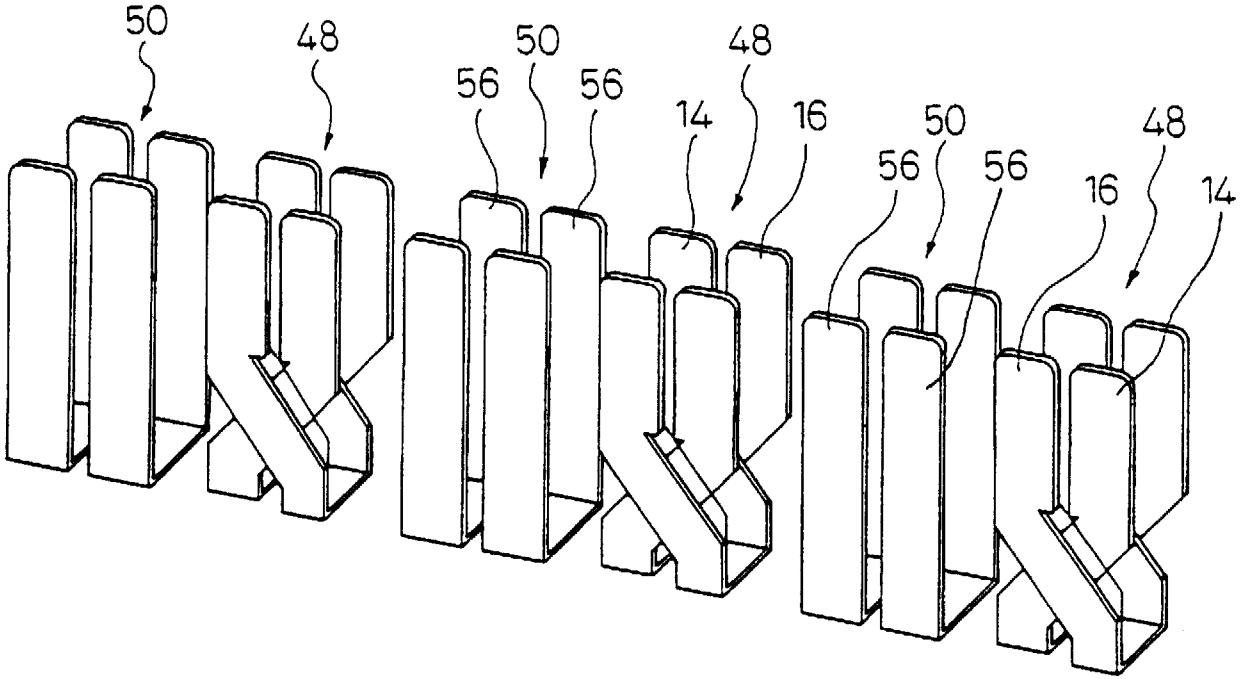
Figure 14:
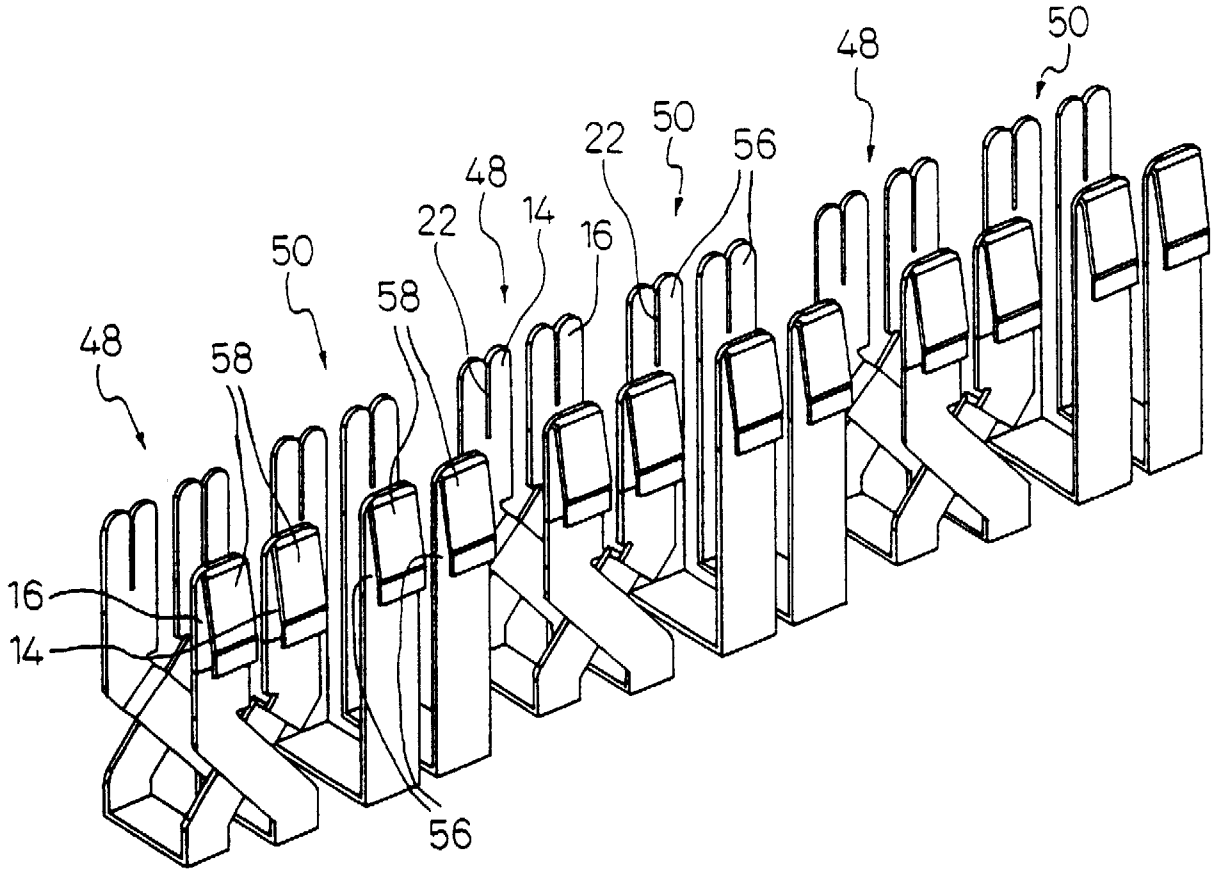

10, 10A, 10B, 10C, 10D, 10E, 10F, 52 contact
12, 54 base section
14, 16, 56 contact section
18, 20 connecting section
18*a*, 20*a* first part
18*b*, 20*b* second part
18*d* third part
18*d* fourth part
22 slot
24 . . . terminal connector
26 . . . body
48, 50 . . . contact pair

We claim:

1. A contact made of an elongated electro-conductive metallic plate with a generally flat surface, which comprises a generally central base section and end contact sections extending generally normal to the base section, thereby forming a zone to be electrically and detachably connected with another electro-conductor at a terminal of an electric wire, characterized in that:

the end contact sections linearly extend generally in the same direction, the generally flat surfaces of the end contact sections being generally parallel and opposed each to the other; each contact section being connected to the base section by respective connecting sections, the connecting sections obliquely extending away from a plane normal to the base section and the connecting sections each having a direction transverse to the contact section; and at least one connecting section having a portion extending in the direction crossing the surface of the contact section.

2. A contact as defined by claim 1, wherein at least one of the contact sections has a slot longitudinally extending from the metallic plate, into which an electric wire is received.

3. A terminal connector comprising a body made of an electro-insulating material and more than one contact-pair to be connected to more than one outer conductor-pair having polarities different from each other, characterized in that: each of the two contacts in the respective contact-pair is made of an elongated electro-conductive metallic plate with a generally flat surface, and comprises a generally central base section, end contact sections linearly extending generally in the same direction normal to the base section while opposing the generally flat surfaces thereof to each other, and connecting sections for connecting the contact sections to the base section and obliquely extending away from a plane normal to the base section and the connecting sections having a direction transverse to the contact sections; in that at least one of the connecting sections in at least one of the two contacts in the contact-pair has a portion extending in the direction crossing to the surface of the contact section; and in that two contacts in the contact-pair are arranged so that the connecting sections of one contact intersects the corresponding connecting sections of the other contact with a small gap therebetween and the respective contact sections of the contacts are arranged generally on two mutually opposed common planes.

4. A terminal connector as defined by claim 3, further comprising second contact-pairs, each having two second contacts made of an elongated electro-conductive metallic plate with a generally flat surface; each second contact comprising a generally central base section and two contact sections linearly extending from the base section generally normal thereto while opposing the generally flat surfaces thereof to each other, and being spaced with each other so as to generally align the respective contact sections of the second contact on mutually opposed two common planes; the respective second contact-pairs being located adjacent to the contact-pairs, of which connecting sections intersect each other, or that the respective contact sections of all the contact-pairs are generally arranged on the mutually opposed two common planes.

5. A terminal connector as defined by claim 3 or 4, wherein each contact of the contact-pairs has a slot for receiving an electric wire, on the contact section extending along at least one of the mutually opposed two common planes; the slot longitudinally extending from the lengthwise end of the metallic plate.

* * * * *